US010024067B2

(12) United States Patent
Gordon

(10) Patent No.: US 10,024,067 B2
(45) Date of Patent: Jul. 17, 2018

(54) DOOR ASSEMBLY INSTALLATION TOOL

(71) Applicant: Randy S. Gordon, Hesperia, MI (US)

(72) Inventor: Randy S. Gordon, Hesperia, MI (US)

( * ) Notice: Subject to any disclaimer, the term of this patent is extended or adjusted under 35 U.S.C. 154(b) by 0 days.

(21) Appl. No.: 15/144,276

(22) Filed: May 2, 2016

(65) Prior Publication Data

US 2016/0319557 A1 Nov. 3, 2016

Related U.S. Application Data

(60) Provisional application No. 62/155,122, filed on Apr. 30, 2015.

(51) Int. Cl.
*E04F 21/00* (2006.01)

(52) U.S. Cl.
CPC ..... *E04F 21/0015* (2013.01)

(58) Field of Classification Search
CPC ..... E04F 21/0015
USPC ..... 49/380; 206/325
See application file for complete search history.

(56) References Cited

U.S. PATENT DOCUMENTS 978,781 A 12/1910 Rhoads
2,547,489 A 4/1951 Priebe
2,634,507 A 4/1953 Boatwright
2,779,021 A 1/1957 Swarzman
2,812,589 A * 11/1957 Wiediger ..... B25H 7/04 144/27
3,307,268 A 3/1967 Deacon, Sr.
4,161,821 A * 7/1979 Miller ..... B25H 7/04 33/41.1
4,181,295 A 1/1980 Duffy
4,989,336 A 2/1991 Waltrip, Jr. et al.
5,123,172 A 6/1992 Thrun
5,209,017 A * 5/1993 Ridge ..... E06B 7/00 206/325
5,253,154 A * 10/1993 McMahan ..... B60Q 1/0686 33/335
5,365,697 A * 11/1994 Vanderpan ..... E06B 7/00 49/371
5,396,707 A 3/1995 Blase
5,655,332 A * 8/1997 Papadopoulos ..... E06B 7/00 206/325
5,669,153 A 9/1997 Hood
6,126,156 A 10/2000 Brodeur
6,293,061 B1 9/2001 Horak, Jr.
6,532,674 B2 3/2003 Farese
6,729,088 B2 5/2004 Corr
6,807,777 B2 10/2004 Wagner et al.
6,971,514 B2 * 12/2005 VanderWerf ..... E06B 7/28 206/325
7,281,338 B2 10/2007 Ziegmann et al.
7,509,750 B2 3/2009 Cameron
(Continued)

*Primary Examiner* — Katherine W Mitchell
*Assistant Examiner* — Catherine A Kelly
(74) *Attorney, Agent, or Firm* — Price Heneveld LLP

(57) ABSTRACT

An alignment tool for a door is provided herein. The alignment tool includes a body portion and a planar alignment portion extending from a common edge. The body portion has a first predefined thickness and the planar portion has a second predefined thickness. A plurality of bosses extends outward from the body portion. An alignment tool engagement feature is disposed on the alignment portion that is configured to engage to a door frame assembly mounting bracket having a corresponding engagement feature.

17 Claims, 9 Drawing Sheets

(56) References Cited

U.S. PATENT DOCUMENTS

| | | | | |
|---|---|---|---|---|
| 7,581,352 | B2 * | 9/2009 | Klingbyle | E06B 7/28 206/325 |
| 7,587,833 | B2 | 9/2009 | Bittner et al. | |
| 7,591,073 | B1 | 9/2009 | Eckles et al. | |
| 7,716,886 | B2 | 5/2010 | Gordon | |
| 7,730,623 | B2 | 6/2010 | Lien | |
| 7,882,662 | B2 | 2/2011 | Root et al. | |
| 8,001,668 | B2 | 8/2011 | Coffman, Jr. et al. | |
| 8,251,356 | B2 | 8/2012 | Eschenburg | |
| 8,333,359 | B2 * | 12/2012 | Gordon | E06B 1/6015 248/223.21 |
| 8,720,073 | B1 | 5/2014 | Gordon | |
| 2003/0005641 | A1 * | 1/2003 | Eakes | E06B 7/28 49/380 |
| 2005/0022397 | A1 | 2/2005 | Neblo | |

* cited by examiner

DOOR ASSEMBLY INSTALLATION TOOL

CROSS-REFERENCE TO RELATED APPLICATION

This application claims benefit from U.S. Provisional Patent Application No. 62/155,122, which was filed on Apr. 30, 2015, entitled "DOOR ASSEMBLY INSTALLATION TOOL," there entire disclosure of which is hereby incorporated herein by reference.

FIELD OF THE INVENTION

The present disclosure generally relates to door installation, and more particularly, to door installation assemblies utilizing brackets for attachment of the door to the door opening.

SUMMARY OF THE DISCLOSURE

According to one aspect of the present invention, an alignment tool for a door is disclosed. The alignment tool includes a body portion having top and bottom surfaces defining a first thickness and a planar alignment portion having inner and outer surfaces that define a second thickness. The inner surface of the alignment portion extends orthogonally from the bottom surface of the body portion. A plurality of bosses extend outwardly from the bottom surface of the body portion. An alignment tool engagement feature is disposed on the alignment portion. The engagement feature is configured to engage to a door frame mounting bracket having a corresponding attachment feature.

According to another aspect of the present invention, an assembly for mounting door brackets is disclosed. The assembly includes a bracket including a jamb flange and a wall flange, with a common edge extending therebetween. The jamb flange and the wall flange intersect at the common edge. An alignment tool has a body portion and a planar alignment portion extending therefrom and an engagement feature disposed on an outer surface of the planar alignment portion proximate the body portion. The engagement feature is configured to engage with a portion of the wall flange such that the bracket maintains a substantially stationary position when placed against a jamb and engaged with the engagement feature of the alignment tool.

According to another aspect of the present invention, an alignment tool for a door is disclosed. The alignment tool includes a planar alignment portion extending orthogonally from a body portion, the planar alignment portion having first and second parallel edges disposed outwardly of the body portion. A support structure is disposed within and integrally formed with the body portion. A plurality of bosses extend outwardly from the support structure and are configured to depress into a component when pressure is applied to the body portion thereby marking predefined fastener locations that correlate to a mounting pattern of fasteners.

According to yet another aspect of the present invention, a pre-hung door assembly is disclosed. The assembly includes a door mounted to a door frame, the door frame including a top door frame member connected on each side thereof to first and second door frame side members, the first and second door frame side members extending below the door on end portions that are opposite to the top door member. An alignment tool has a body portion that extends orthogonally from a planar portion. The planar portion includes a coupling portion attached thereto. A weakened portion separates the planar portion from the coupling portion. A fastener removably couples the planar portion of the alignment tool to the door frame.

According to yet another aspect of the present invention, a pre-hung door assembly is disclosed. The pre-hung door assembly includes a door mounted to a door frame. An alignment tool having a body portion extends from a planar portion. A void is disposed within the body portion of the alignment tool. A fastener is disposed through the void and removably coupled to a bottom surface of the door. The fastener is configured to hold the door in a constant position.

These and other aspects, objects, and features of the present invention will be understood and appreciated by those skilled in the art upon studying the following specification, claims, and appended drawings.

DETAILED DESCRIPTION OF THE PREFERRED EMBODIMENTS

As required, detailed embodiments of the present invention are disclosed herein. However, it is to be understood that the disclosed embodiments are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

The following disclosure describes an alignment tool for installing a door. The alignment tool may advantageously employ one or more features that assist in the installation process of the door. The door assembly may include jamb brackets for attaching the door to a door opening. Although the alignment tool described herein is designated for utilization in door installation, it is contemplated that the alignment tool may be used for installation of a jamb or frame for a door, window, skylight, or the like in any opening in a building wall.

Figure 1:
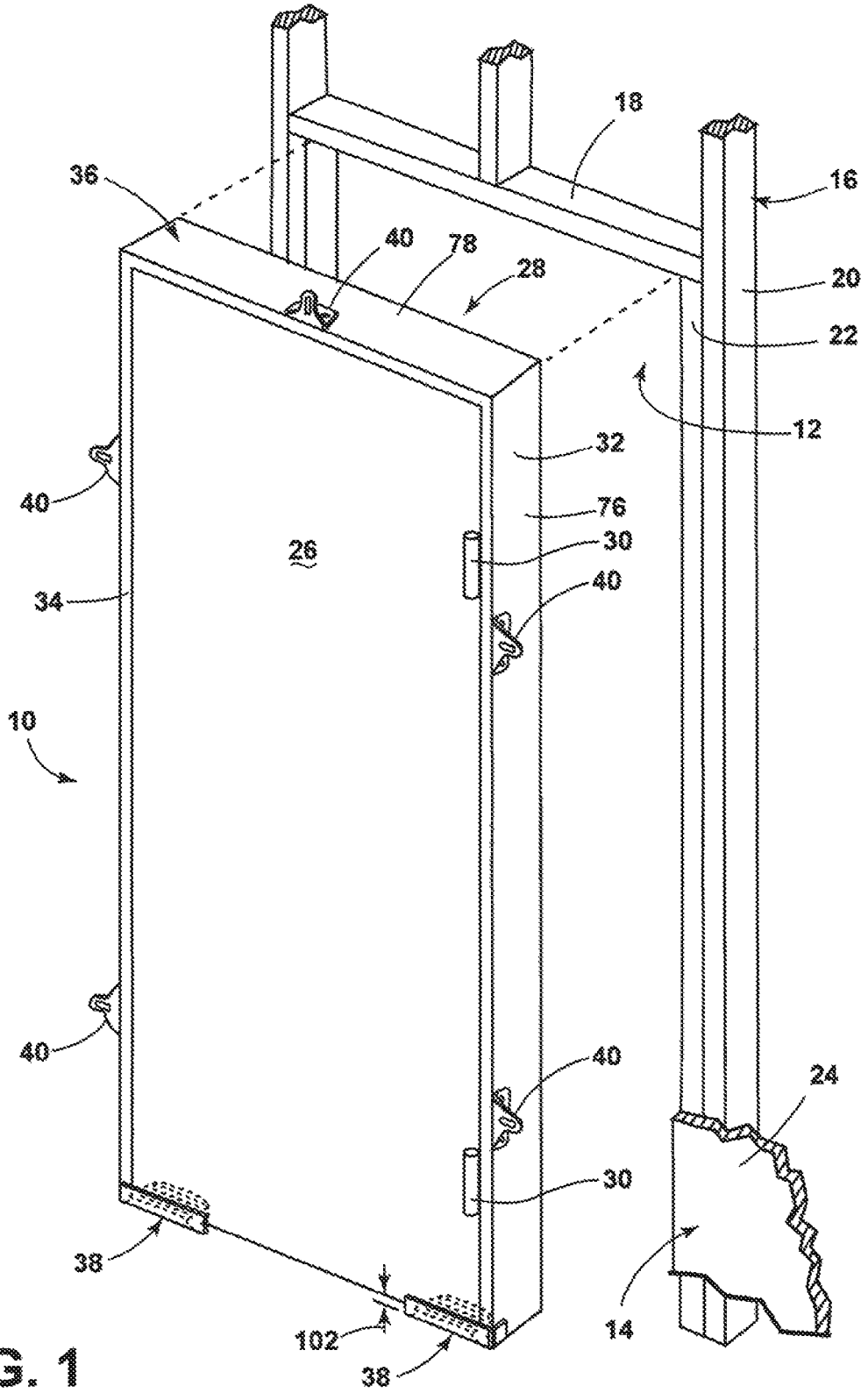
FIG. 1 is a perspective view showing a pre-hung door assembly having mounting brackets and an alignment tool, according to one embodiment.

Referring to the FIG. 1, a pre-hung door assembly 10 is illustrated in position to be mounted in a door opening 12 in a building wall 14, wherein the door opening is surrounded by wall frame members 16, including a header 18 at the top of the rough opening and vertical members or studs 20. The frame members 16 may further include liner members 22. The wall frame members 16 may be covered with drywall 24 or any other covering surface.

The pre-hung door assembly 10 includes a door 26 mounted to a door frame 28 by hinges 30 on a hinge side 32 of the door frame 28 and the door 26. The opposite side of the door frame 28 and the door 26 may be configured as a latch side 34. The prefabricated door frame 28 also includes a header member 36 extending across the upper ends of the side members 32 and 34. The door 26 may be preassembled in the frame 28, and the door and jamb assembly 10 may be mounted as a unit in the door opening 12 defined by the wall frame member 16.

An alignment tool 38 may be utilized proximate a bottom portion of the door 26 to hold the door 26 in a substantially constant position prior to attachment of the door 26 to a building wall 14. As will be described in greater detail below, the alignment tool 38 has a body portion 42 and a planar portion extending 44 therefrom. The body portion 42 has a first predefined thickness. The predefined thickness may be sized to correspond with a distance 102 between the bottom of the door 26 and the bottom of the door frame side member 32. Similarly, the planar portion 44 has a second predefined thickness. The predefined thicknesses may be based on a desired thickness for installing the pre-hung assembly 10.

Figure 2:
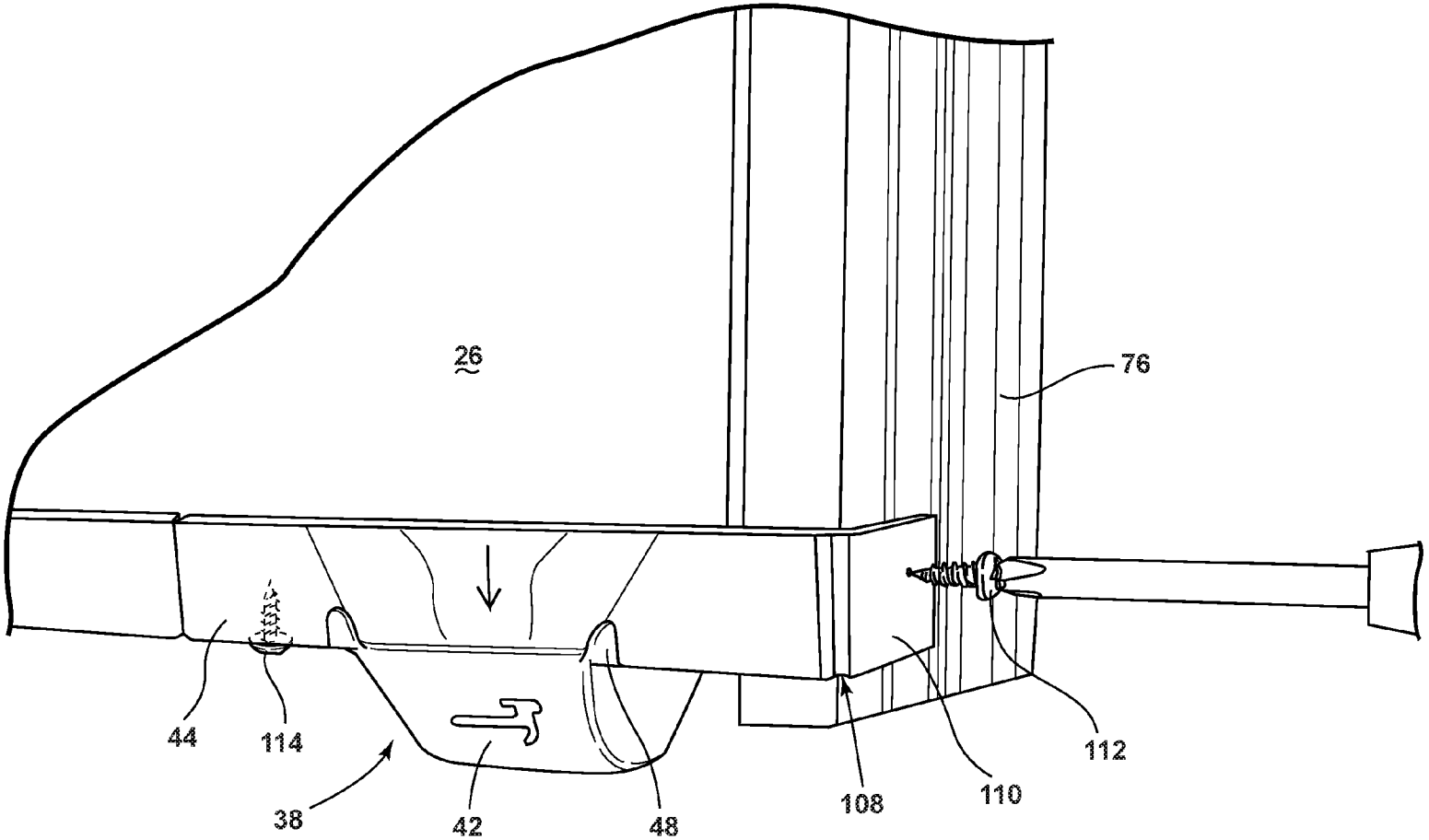
FIG. 2 is a fragmentary perspective view of a pre-hung door assembly showing an alignment tool supporting a bottom surface of the door.

Referring to FIG. 2, the alignment tool 38 may be configured to retain the door 26 in a substantially constant position while packaged. Accordingly, the alignment tool 38 may have a body portion 42 disposed under the door 26 and a planar portion 44 disposed against a vertical surface of the door 26. The planar portion 44 may also have a coupling portion 110 extending orthogonally from a common edge 108. The common edge 108 may be a living hinge, perforated, or otherwise weakened, such that the coupling portion 110 may be separated from the planar portion 44 once the pre-hung door 26 is ready to be fixed to a wall 16. A fastener 112 may be disposed through the coupling portion 110 and into an outer side surface 76 of the door frame side member 32 to removably attach each alignment tool 38 in position while the pre-hung door assembly 10 is transported.

The body portion 42 of the alignment tool 38 may also include a void 106 through which a second fastener 114 may be disposed. The second fastener 114 may be removably coupled to a bottom surface of the door 26, thereby assisting in holding the door 26 in a constant position. It should be appreciated that the pre-hung door assembly 10 may include only the first 112 or second fastener 114, and need not include both components.

Further, it should be appreciated that the body portion 42 may extend downwardly of the door frame side member 76. With the alignment tool 38 removably attached to the bottom of the door 26 and the body portion 42 extending beyond the door frame side member 76, heavy doors may be easy to move as the pre-hung door assembly 10 may be slid on a ground surface. Additionally, the body portion 42 may also incorporate a curved structure such that the body portion 42 may further assist in sliding the pre-hung door assembly 10 along the ground surface.

Figure 3:
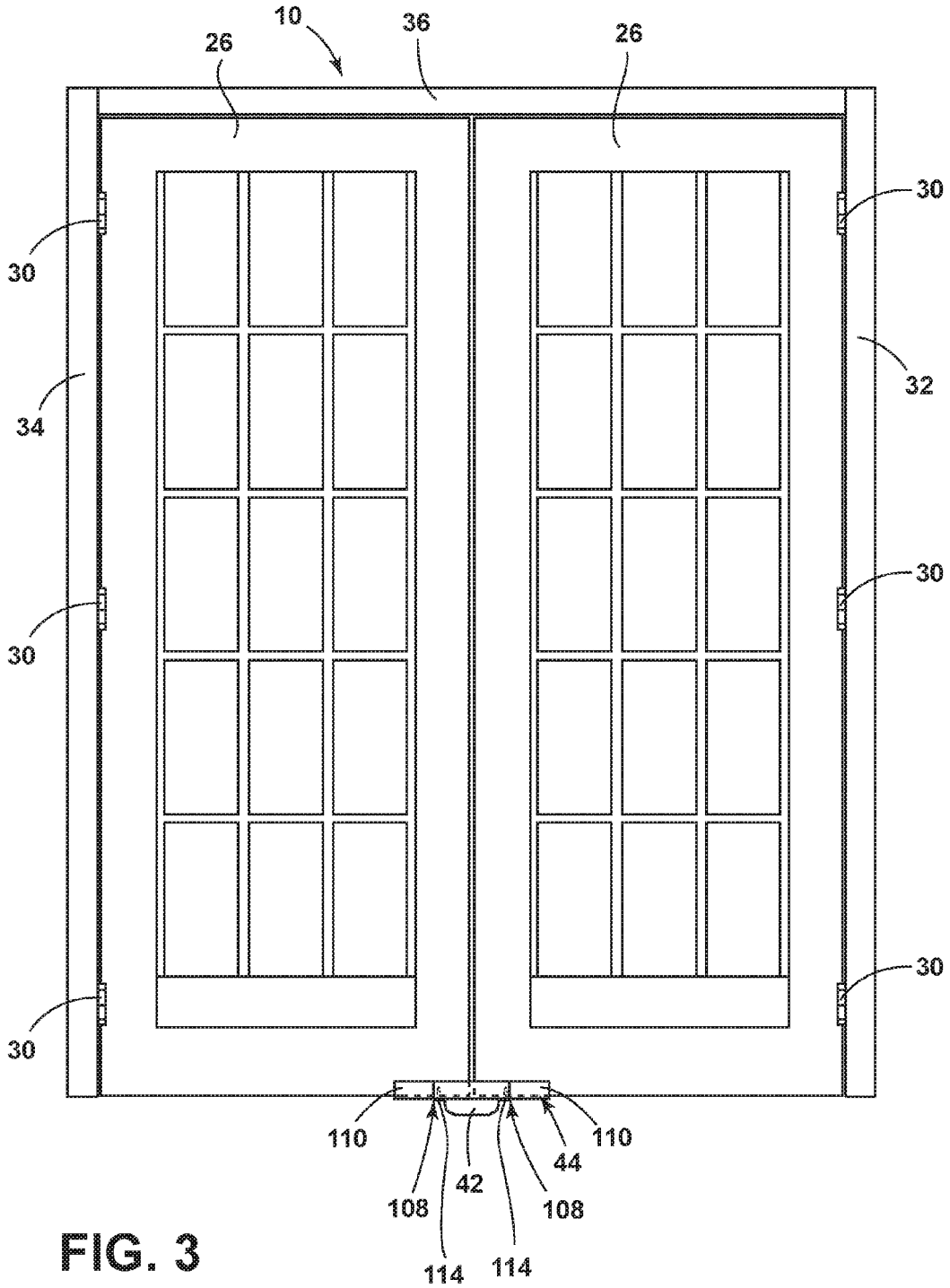
FIG. 3 is a front perspective view of a pre-hung door assembly showing the alignment tool supporting a bottom surface of a pair of doors simultaneously, according to one embodiment.

Referring to FIG. 3, the alignment tool 38 may include a pair of coupling portions 110 that extend from any side of the planar portion 44 of the alignment tool 38. Through the use of a plurality of coupling portions 110, a single alignment tool 38 may be used on a multitude of doors 26 each having a different configuration, including, but not limited to, single doors 26 with hinges 30 on the first door frame side member 34, or double doors 26 with hinges 30 on both opposing door frame side member 32, 34.

As illustrated in FIG. 3, the alignment tool 38 may have a pair of coupling portions 110 on opposing ends of the planar portion 44 configured to contact a surface of both doors 26 in a two door configuration, such as French doors. A pair of fasteners 114 are disposed through the voids 106 in the body portion 42 and removably coupled to the bottom surface of each door 26. By disposing a fastener 114 in each door 26, the doors 26 may maintain a substantially constant position through the use of a single alignment tool 26. It should be appreciated that in alternate embodiments, any number of alignment tools 38 may be utilized for maintaining proper position of each respective door 26. Additional alignment tools 38 may be helpful in sliding the pre-hung door assembly 10 along the ground to a desired location.

Figure 4A:
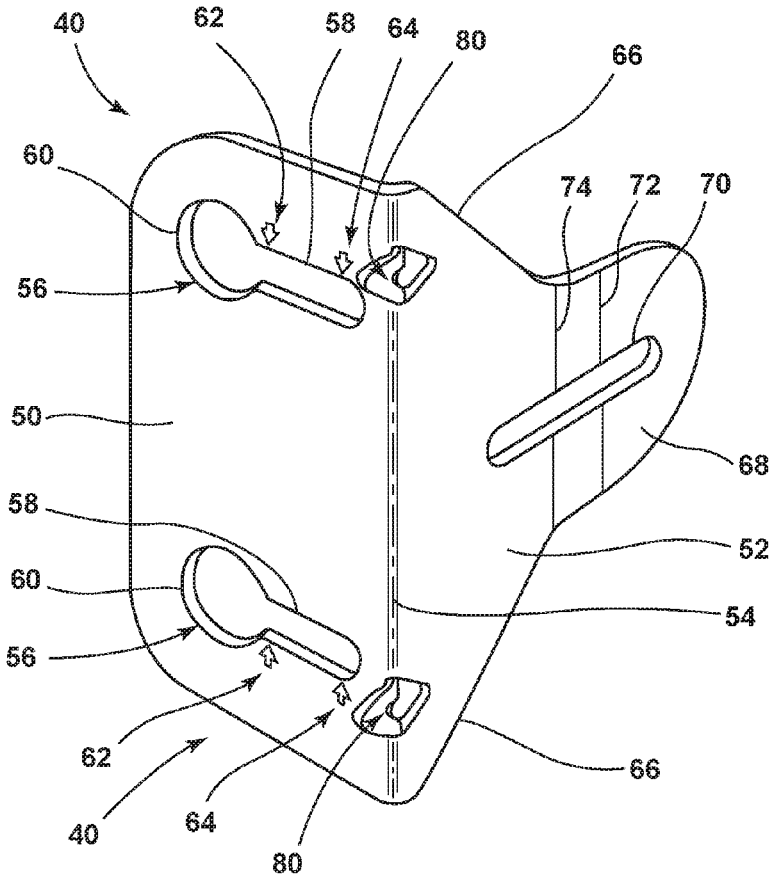
FIG. 4A is a perspective view of a jamb bracket, according to one embodiment.
Figure 4B:
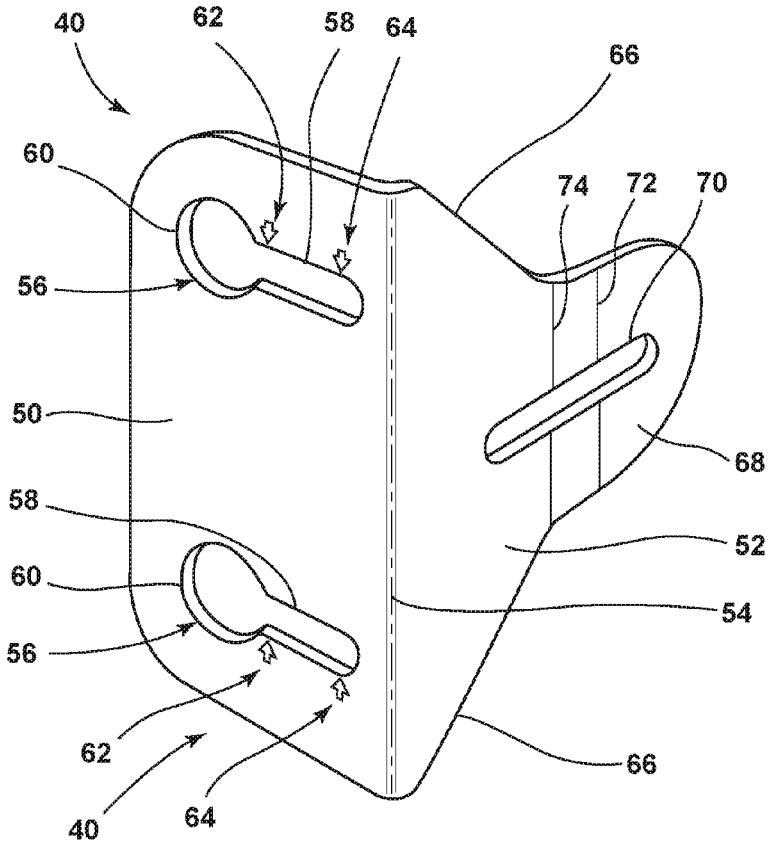
FIG. 4B is a perspective view of an alternate jamb bracket having stops thereon, according to one embodiment.

Referring to FIGS. 4A-4B, each of the illustrated exemplary jamb brackets 40 include a jamb flange 50, a wall flange 52, and an edge 54 extending between the two flanges 50, 52. In some embodiments, the jamb flange 50 and the wall flange 52 forms a right angle at the edge 54. The bracket 40 may be formed of a bendable sheet material, such as an anodized or other corrosion resistant metal. According to the illustrated embodiments, the jamb flange 50 includes a pair of keyhole slots 56 extending from a narrow portion 58, adjacent the edge 54, to an enlarged portion 60 at the end of the slot 56 away from the edge 54. Position markers 62 and 64 are spaced along the narrow portion 58 of the keyhole slot 56 to indicate proper fastener locations for mounting the jamb bracket 40 to the frame 28 of the pre-hung door assembly 10.

The wall flange 52 includes inwardly tapered sides 66 extending away from the edge 54, with the tab 68 extending outwardly from the ends of the tapered sides 66. A slot 70 is positioned in the wall flange 52 and oriented perpendicularly to the edge 54. A pair of positioning lines or indicators 72 and 74 extends transversely to the slot 70 at spaced locations in order to facilitate aligning the flanges with a plumb line that is drawn on the wall, which according to one embodiment, may be about one-half inch from the door opening. The alignment tool 38 has two sets of planar edges 86, 88 that may be utilized for marking the plumb lines.

According to one embodiment, the jamb flange 50 of the bracket 40 is intended to be attached to outer side members 32, 34 of the door frame 28, with the wall flange 52 extending perpendicularly away from the jamb flange 50 over the surface of the wall 14. The proper positioning of the jamb flanges 50 is determined by the nature of the wall 50 to which the frame 28 is mounted. Also, it should be appreciated that the alignment tool 38 described herein may be used with any type of wall and any type of bracket, in which case, the teachings provided herein similarly apply.

Once the jamb flange 50 is mounted on the frame 28, the door 26 is plumbed by reference to lines 72 or 74 and the wall flange 52 is attached to the door opening 12. In one typical installation, the wall flange 52 is mounted over a wall covering such as drywall As shown in FIG. 4B, positioning stops 80 may extend perpendicularly from the jamb flange 50 at the edge 54. The stops 80 may engage the edge of the frame 28 as the jamb flange 50 is slid inwardly on the frame 28, positioning the edge 54 at the edge of the frame 28. This positions the edge of the door frame 28 at the surface of the wall 14, which is normally desirable. However, it may be desired to position the wall flange behind the drywall 24 or otherwise further inwardly on the frame 28.

While the pre-hung door assembly 10 is aligned with respect to the surfaces and the walls 14 of the rough opening 12, the door brackets 40 and the lockset bracket maintain the relationship between the components while the user makes adjustments to the pre-hung door assembly 10, such as leveling, aligning, and orienting the pre-hung door assembly 10 with respect to the surfaces and the wall 14 of the rough opening 12.

After the pre-hung door assembly 10 is aligned in a desired position, the door frame 36 is fixedly attached to the surfaces 18, 20 of the rough opening 12 such as by nailing or the like. After the pre-hung door assembly 10 is attached to the surfaces 18, 20, the pre-hung door assembly 10 is typically framed with molding (not shown) or the like that attaches to the walls 14 and covers the exterior surface of the frame 36 of the door pre-hung door assembly 10 to provide a pleasing appearance as is known in the art. The alignment tool 38 may be utilized during this process for many tasks, such as holding the brackets 40 in place while each respective bracket is mounted, aligning the door 26, marking appropriate fastener 112 locations, etc.

After the pre-hung door assembly 10 is aligned in a desired position, the door frame 36 is fixedly attached to the surfaces 18, 20 of the rough opening 12 such as by nailing or the like. After the pre-hung door assembly 10 is attached to the surfaces 18, 20, the pre-hung door assembly 10 is typically framed with molding (not shown) or the like that attaches to the walls 14 and covers the exterior surface of the frame 36 of the door pre-hung door assembly 10 to provide a pleasing appearance, as is known in the art.

Figure 5:
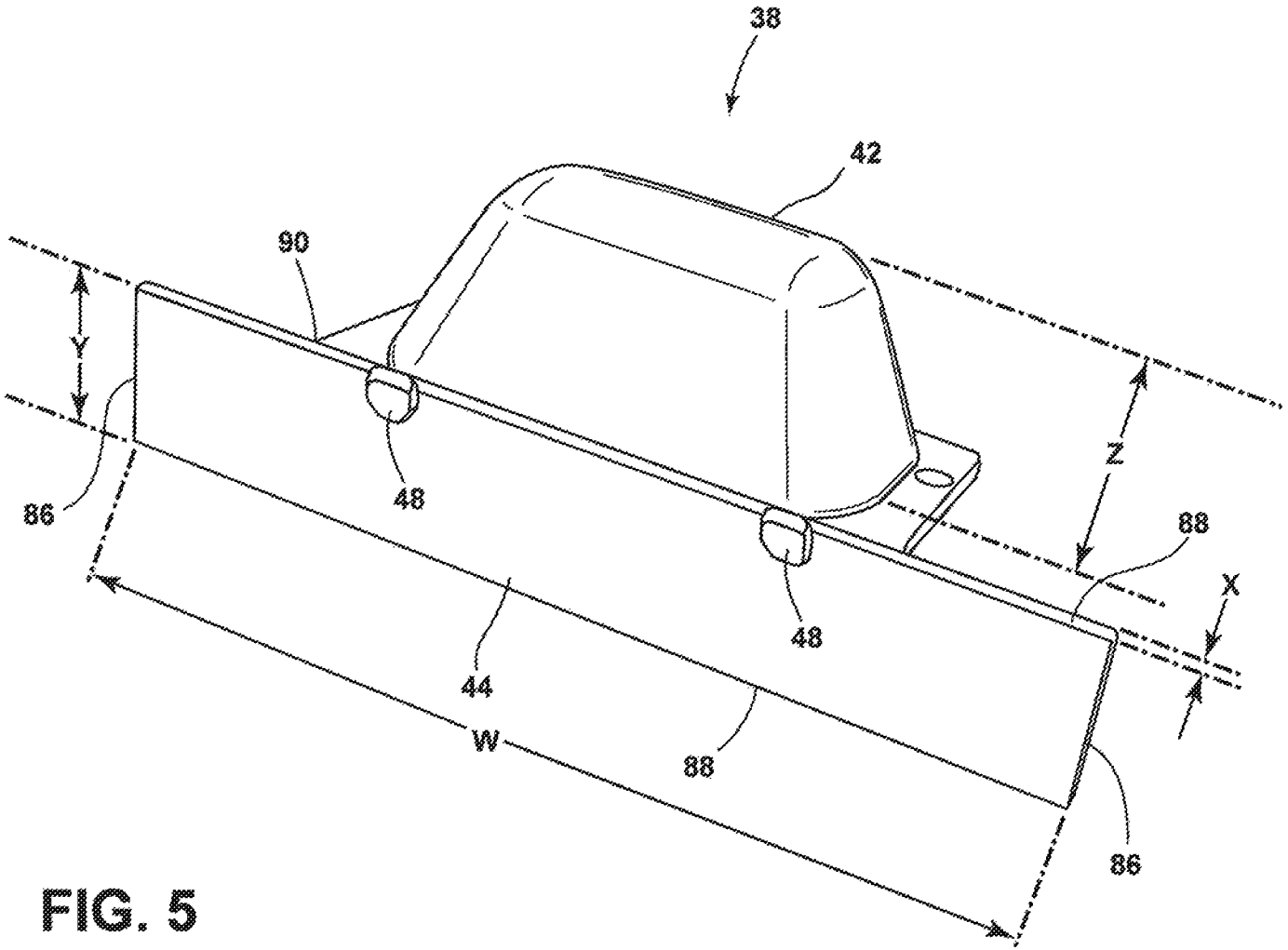
FIG. 5 is a perspective view of the alignment tool having an engagement feature configured as tabs, according to one embodiment.
Figure 6:
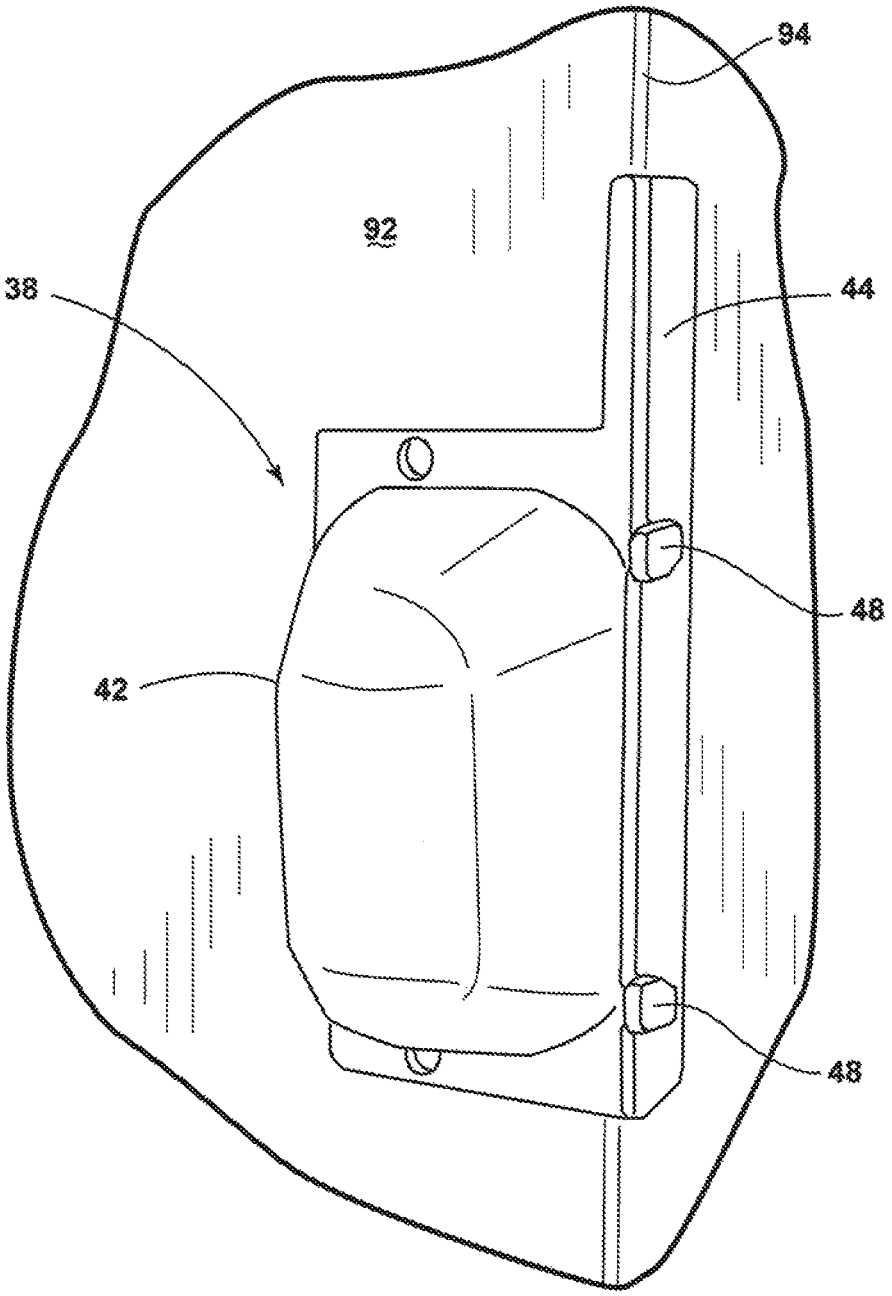
FIG. 6 is a perspective view of the alignment tool disposed against a door frame component.

Referring to FIGS. 5 and 6, an exemplary embodiment of the alignment tool 38 is illustrated having a body portion 42 and a planar alignment portion 44, extending from a common edge 90. The two portions 42, 44 may form a right angle to one another at the common edge 90. The alignment tool 38 is a handheld device that assists in mounting a door 26, or window, to a frame 28. The alignment tool 38 may be constructed of any suitable material such as a relatively rigid polymer, a metallic material, or any other material known in the art. To accommodate different assemblies, the alignment tool 38 has predetermined measuring or marking edges 86, 88 and can be made in differing sizes to meet the specific needs of a particular job.

The planar portion 44 has an engagement feature disposed on a surface thereof, which may be configured as a pair of symmetrical tabs 48. The tabs 48 may contact, attach, or engage with the jamb bracket 40 to removably hold a jamb bracket 40 in a desired location while mounting the door assembly 10.

The body portion 42 of the alignment tool 38 has a first predefined thickness z that may correlate to the distance a door is offset from a floor disposed below the door. The planar alignment portion 44, of the illustrated embodiment, has a length w that may extend beyond both sides of the body portion 42. The planar alignment portion 44 also has a predefined width y. The width of the planar alignment portion 44 may be configured based on a desired offset distance that may be measured from the corner of a frame 28 to the edge of planar alignment portion 44, which would be a distance y from the corner of a wall 14. Lastly, the planar alignment portion 44 may have a predefined thickness x such that the planar alignment portion 44 may be utilized as a temporary shim while mounting the door assembly 10.

According to one embodiment, the thickness of the body portion 42 is less than 2 inches and configured such that the body portion 42 may contact both the bottom surface of a door 26 and a floor when the door is in the installed position. The thickness of the planar alignment portion 44 is configured to be less than 2 inches and may also be used to verify door gaps. The door gap may be the space between the door and door frame 36 or the gap between the door frame 36 and surrounding wall structure 14.

As shown in FIG. 6, the alignment tool 38 is disposed on a frame component 92 in order to determine the proper edge setback for any molding or trim that may be installed. The frame 92 could be that of a door or window to which decorative molding, trim or the like is applied after installing the door frame. In order to draw the straight line on the frame component 92 with a predetermined distance from a corner 94 thereof, a width of the planar alignment portion 44 is pre-configured. For example, the width of the planar alignment portion 44 may be pre-configured as ½ inch, 1 inch, or larger. Similarly, the planar edge 86 or 88 of the alignment portion 44 may be utilized as a marking point. It should be appreciated that the alignment tool 38, and portions 42, 42 thereof, may be used for any necessary marking while installing a door 26.

Figure 7:
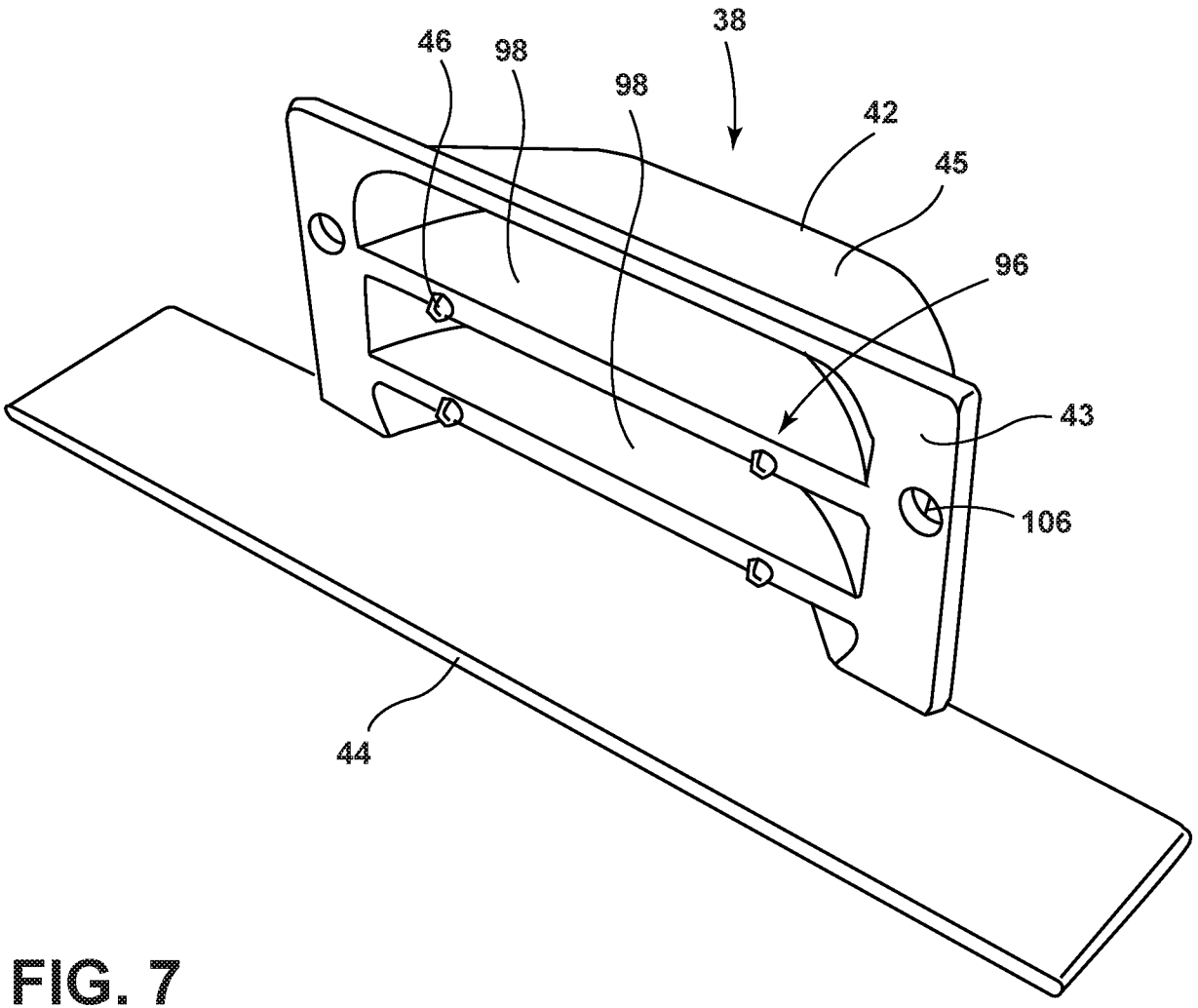
FIG. 7 is a perspective view of the alignment tool including a plurality of bosses on a body portion of the alignment tool, according to one embodiment.

Referring to FIG. 7, the alignment tool 38 has a body portion 42 that includes a rectangular base 43 and a centrally located trapezoidal member 45 extending therefrom. The alignment tool 38 may further include a support structure 96 within the body portion 42. In the illustrated embodiment, the support structure 96 is configured as a pair of parallel ribs 98 extending transversely through the body portion 42 of the alignment tool 38. The ribs 98 may also be parallel to the planar alignment portion 44.

A plurality of bosses 46 may be disposed the pair of ribs 98 that extend outwardly from the ribs 98. The bosses 46 may each have a central axis that is parallel to the planar portion 44. The bosses 46 are positioned such that a desired pattern of detents may be depressed in a frame component 92 for attaching a door mounting component, such as the jamb bracket 40. According to one embodiment, a jamb bracket 40, such as the ones described above, includes position markers 62 and 64 that are spaced along the narrow portions 58 of the keyhole slots 56 indicating the proper fastener locations for mounting the jamb bracket 40 to the frame 28. The bosses 46 disposed on the ribs 98 may correlate to the same locations as the position markers 62 and 64. It is contemplated, however, that the bosses 46 may be on any portion of the alignment tool 38 and may be used for marking any component of the door assembly 10.

To use the bosses 46 to mark a proximate frame component 92, the alignment tool 38 is placed at a desired location. Pressure is then applied to the alignment tool 38 such that the bosses 46 are depressed into the frame component 92 to mark the proper positions for conventional fasteners, threaded or otherwise, to be used to fasten a first component of the assembly to a second.

Additionally, as discussed above, the alignment tool 38 may further include voids 106 in the body portion 42 or the planar portion 44. The voids 106 may be offset at a predefined distance from the common edge 90 separating the body portion 42 from the planar alignment portion 44. The voids 106 are also offset from one another, if multiple voids 106 are present, at a predefined distance. Through the use of voids 106, a user may mark a desired point through the void 106, a drill bit may be disposed through the void 106, or a fastener may be attached through a void 106.

Figure 8:
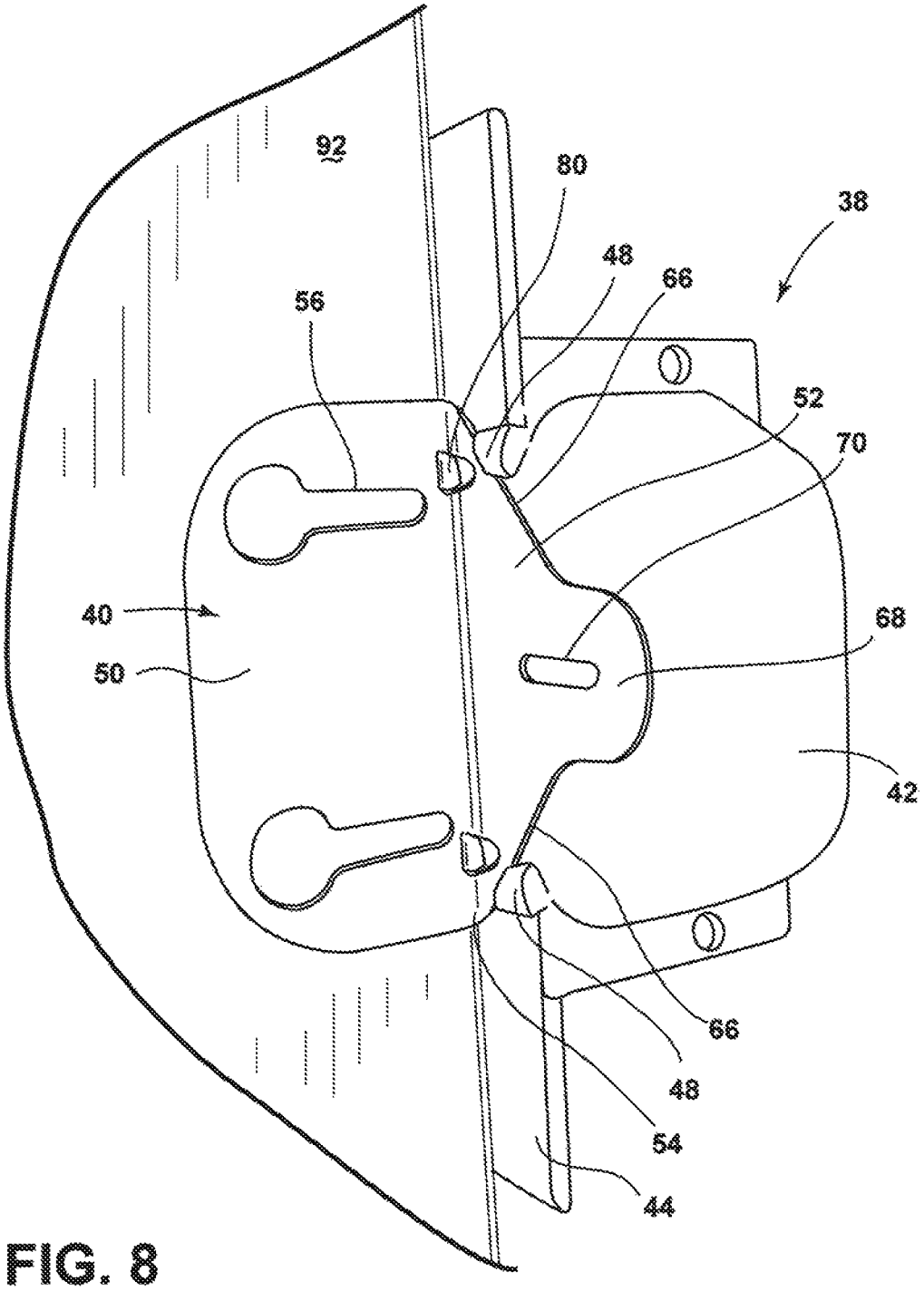
FIG. 8 illustrates the alignment tool engaged with a bracket, according to one embodiment.

Referring to FIG. 8, the alignment tool 38, according to one embodiment, supports a jamb bracket 40 through the use of two tabs 48 on the planar portion 44 of the alignment tool 38. The tabs 48 on the planar portion 44 contact a corresponding attachment feature on the bracket 40, such as engagement feature, or the inwardly tapered sides 66 of the bracket 40 that extend away from the edge 54 thereof.

As illustrated in FIG. 8, the wall portion 50 of the jamb bracket 40 is placed against a wall 14 and the stops 80 on the jamb bracket 40 wrap around the corner of the wall 14, as described above in FIG. 4B. Thus, the stops 80 on the jamb bracket 40 retain the jamb bracket 40 in a first direction while the alignment tool 38 holds the wall portion 52 of the jamb bracket 40 against the surface in a second direction. Since the jamb bracket 40 is supported in the first and second directions, the jamb bracket 40 may be held substantially stationary during the door mounting process through pressure applied to the components and the frictional force formed therefrom.

Alternatively, the alignment tool 38 may include all necessary positioning features thereon for attaching a jamb bracket 40 to a frame member 92. Thus, a jamb bracket 40, such as the one illustrated in FIG. 4A, need not have stops 80, or any other positioning features thereon. For example, the jamb bracket 40 may be held stationary when the jamb flange 50 is disposed against a frame member 92 and the tabs 48 on the alignment tool 38 are in contact with the wall flange 52. In such a configuration, the planar portion 44 of the alignment tool 38 may be held flush against an adjacent surface of the frame member 92 to provide proper alignment. Accordingly, the jamb bracket 40 may be utilized to align and attach any jamb bracket 40 to a supporting structure.

Although the alignment tool 38 is illustrated having two symmetrical tabs 48 on a planar portion 44 of the alignment tool 38, it is contemplated that the alignment tool 38 may include any number of tabs 48, or any other form of engagement feature, such as clips. Additionally, the alignment tool 38 may hold the jamb bracket 40 against any surface through contact with any portion of the jamb bracket 40. Further, the alignment tool 38 may be made of, or contain, a magnetic or adhesive material for removably coupling the jamb bracket 40 to the alignment tool 38 during the installation process.

Accordingly, alignment tool for installing a door has been advantageously described herein according to exemplary embodiments. The alignment tool may allow for improved, easier, and quicker installation of a pre-hung door assembly. In addition, the alignment tool is advantageously reusable such that a plurality of pre-hung door assemblies may be installed utilizing the same alignment tool. The alignment tool may provide various additional benefits including a bracket holding features, marking features, alignment features, etc.

It is also important to note that the construction and arrangement of the elements of the disclosure as shown in the exemplary embodiments are illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown in multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system might be constructed from any of the wide variety of materials that provide sufficient strength or durability, in any of the wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is to be understood that variations and modifications can be made on the aforementioned structure without departing from the concepts of the present disclosure, and further it is to be understood that such concepts are intended to be covered by the following claims unless these claims by their language expressly state otherwise.

What is claimed is:

1. An alignment tool for a door, comprising:

a body portion having top and bottom surfaces defining a first thickness and a planar alignment portion having inner and outer surfaces that define a second thickness, the inner surface of the alignment portion extending orthogonally from the bottom surface of the body portion;

a plurality of bosses extending outwardly from the bottom surface of the body portion, wherein the bosses each have a central axis that is parallel to the planar alignment portion; and an alignment tool engagement feature disposed on the alignment portion and configured to engage to a door frame mounting bracket having a corresponding attachment feature, wherein alignment tool engagement feature extends in a direction perpendicular to the plurality of bosses, the alignment tool configured to removably couple to said door to hold said door in a fixed position relative to a door frame, mark a component of a door assembly, and support a jamb bracket against the alignment tool.

2. The alignment tool for a door of claim 1, wherein the first thickness of the body portion is less than 3 inches and configured such that the body portion may contact both the bottom surface of the door and a floor when the door is in an installed position.

3. The alignment tool for a door of claim 1, wherein the engagement feature is configured as a pair of tabs that contact a wall flange portion of the door frame mounting bracket placing the mounting bracket in a constant position between the alignment tool and a wall frame.

4. The alignment tool for a door of claim 1, wherein the body portion includes a substantially rectangular base and centrally located trapezoidal member extending therefrom.

5. An assembly for mounting door brackets, the assembly comprising:

a bracket including a jamb flange and a wall flange, with a common edge extending therebetween, wherein the jamb flange and the wall flange intersect at the common edge; and an alignment tool having a body portion and a planar alignment portion and first and second tabs adapted to contact first and second opposing inwardly tapered sides on the wall flange to maintain a substantially stationary position against a frame and the engagement feature of the alignment tool, the alignment tool configured to removably couple to a door to hold the door in a fixed position relative to a door frame, mark a component of a door assembly, and support a jamb bracket against the alignment tool.

6. The assembly for mounting door brackets of claim 5, further comprising:

a plurality of bosses integrally formed with the body portion, the bosses configured to correspond to predefined fastener locations on the jamb flange of the bracket.

7. An alignment tool for a door, comprising:

a planar alignment portion extending orthogonally from a body portion, the planar alignment portion having first and second parallel edges disposed outwardly of the body portion;

a pair of ribs extending transversely along the body portion of the alignment tool disposed within and integrally formed with the body portion, the ribs and body portion forming a plurality of cavities within the body portion; and a plurality of bosses extending outward from the support structure and configured to depress into a component when pressure is applied to the body portion thereby marking predefined fastener locations that correlate to a mounting pattern of fasteners, the alignment tool configured to removably couple to said door to hold said door in a fixed position relative to a door frame, mark a frame component, and support a jamb bracket against the alignment tool.

8. The alignment tool for a door of claim 7, wherein the pair of ribs are parallel to the planar alignment portion of the alignment tool.

9. The alignment tool for a door of claim 7, wherein each boss has a central axis that is parallel to the planar alignment portion.

10. The alignment tool for a door of claim 7, further comprising:

an engagement feature disposed on the planar alignment portion configured to hold a bracket in a substantially stationary position when the bracket is disposed between and simultaneously contacting the alignment tool and a frame component.

11. The alignment tool for a door of claim 10, wherein the engagement feature is configured as a pair of symmetrical tabs.

12. A pre-hung door assembly, comprising:

a door mounted to a door frame, the door frame including a top door frame member connected on each side thereof to first and second door frame side members, the first and second door frame side members extending below the door on end portions that are opposite to the top door member;

an alignment tool having a body portion extending orthogonally from a planar portion, wherein the planar portion includes a coupling portion attached thereto, the alignment tool having a predefined thickness equal to a distance between the bottom of the door and the bottom of the door frame side member;

a weakened portion separating the planar portion from the coupling portion, the weakened portion having a thickness that is less than the thickness of the planar portion and the coupling portion; and a fastener removably coupling the planar portion of the alignment tool to the door frame, the alignment tool configured to removably couple to the door to hold the door in a fixed position relative to the door frame, mark a component of the door assembly, and support a jamb bracket against the alignment tool.

13. The pre-hung door assembly of claim 12, further comprising:

a plurality of jamb brackets disposed on the top door frame member and the first and second door frame side members, the jamb brackets configured to attach to an opening in a wall and to the door frame.

14. The pre-hung door assembly of claim 12, wherein the weakened portion may be separated from the planar portion.

15. A pre-hung door assembly, comprising:

a door mounted to a door frame;

an alignment tool having a body portion extending from a planar portion; a void disposed within the body portion of the alignment tool, wherein a central axis of the void is parallel to the planar portion;

a rib disposed within the body portion and extending in a parallel direction to the central axis of the void; and a fastener disposed through the void and removably coupled to a bottom surface of the door, wherein the fastener is configured to hold the door in a constant position, the alignment tool configured to removably couple to the door to hold the door in a fixed position relative to the door frame, mark a component of the door assembly, and support a jamb bracket against the alignment tool.

16. The pre-hung door of claim 15, wherein the planar portion includes a pair of coupling portions extending from two opposing ends of the planar portion, the coupling portions connected to the planar portion through a living hinge.

17. The pre-hung door of claim 15, wherein the alignment tool further comprises a plurality of bosses extending outward from the rib and configured to depress into a frame when pressure is applied to the body portion thereby marking predefined fastener locations that correlate to a mounting pattern of fasteners for a jamb mounting bracket.

* * * * *